US006095168A

United States Patent [19]

Berges

[11] Patent Number: 6,095,168

[45] Date of Patent: Aug. 1, 2000

[54] GRIP FOR AN UMBRELLA CANE OR A WALKING STICK

[75] Inventor: Ruediger Berges, Germering, Germany

[73] Assignee: Ruediger Berges GmbH, Germering, Germany

[21] Appl. No.: 09/117,531

[22] PCT Filed: Dec. 5, 1997

[86] PCT No.: PCT/EP97/06813

§ 371 Date: Oct. 1, 1998

§ 102(e) Date: Oct. 1, 1998

[87] PCT Pub. No.: WO98/24340

PCT Pub. Date: Jun. 11, 1998

[30] Foreign Application Priority Data

Dec. 6, 1996 [DE] Germany ..... 196 50 772

[51] Int. Cl.[7] ..... A45B 3/00; A45B 9/02

[52] U.S. Cl. ..... 135/16; 135/66; 40/317; D3/13

[58] Field of Search ..... 16/111.1; 40/317; 135/16, 66, 76; D3/12, 13, 16

[56] References Cited

U.S. PATENT DOCUMENTS

| | | | |
|---|---|---|---|
| 690,655 | 1/1902 | Khan | 135/66 |
| 1,020,044 | 3/1912 | McGuire | 135/66 X |
| 1,120,092 | 12/1914 | Seeber | 135/66 |
| 1,509,157 | 9/1924 | Leaño | 135/66 |
| 4,088,251 | 5/1978 | Rodriguez | 224/626 |
| 4,733,681 | 3/1988 | Lee | 135/16 |
| 4,790,338 | 12/1988 | Strobl | 135/16 |
| 4,798,219 | 1/1989 | Forde | 135/16 |
| 4,867,187 | 9/1989 | Divine | 135/76 X |
| 5,029,897 | 7/1991 | Borg | 135/66 X |
| 5,261,434 | 11/1993 | Fodero | 135/16 |
| 5,337,771 | 8/1994 | Berges et al. | 135/76 X |
| 5,361,793 | 11/1994 | Stahnke . | |
| 5,476,113 | 12/1995 | Lin et al. . | |

FOREIGN PATENT DOCUMENTS

| | | |
|---|---|---|
| 543 177 | 12/1955 | Belgium . |
| 0 583 761 | 2/1994 | European Pat. Off. . |
| 770 921 | 9/1934 | France . |
| 625 686 | 10/1981 | Switzerland . |
| 769114 | 2/1957 | United Kingdom . |

*Primary Examiner*—Carl D. Friedman
*Assistant Examiner*—Kevin D. Wilkens
*Attorney, Agent, or Firm*—Oblon, Spivak, McClelland, Maier & Neustadt, P.C.

[57] ABSTRACT

A handle for an umbrella or walking stick having a shaft and a hollow hemispherical free end section. The free end section can carry an ornamental or commonplace article. In order to allow different articles to be placed therein, the end section includes a ring which is mounted on an upper surrounding edge of the end section and has a smaller inner circumference than the outer circumference of the article.

20 Claims, 6 Drawing Sheets

GRIP FOR AN UMBRELLA CANE OR A WALKING STICK

BACKGROUND OF THE INVENTION

1. Field of the Invention

The present invention relates to a grip for an umbrella cane or a walking stick, with a hollow shaft and a hemispherical free end section.

2. Discussion of the Background

Grips for umbrellas or walking sticks of this type are known for example in the area of advertising articles, in which the free end section carries an ornamental or commonplace article. Thus the grip is either rigid or attached pivotally through 90° on the umbrella or walking stick. The purpose of the ornamental or commonplace article is to impart to the umbrella or walking stick either an extraordinary appearance, in which the ornamental or commonplace article is for example either coloured, or in order to impart to it a certain additional function, for example incorporates a compass or a radio. In addition, the hemispherical end section provides the grip with better and more reliable handling.

There is for example known from EP 0 583 761 A1 a handle for an umbrella or a walking stick of the type already mentioned, in which the ornamental article is a hemispherical cap which may be coloured.

There is known from FR 770 921 an umbrella handle with a shaft and a thickened end section forming the free end of the umbrella, which has a trough-like seat for receiving an ornamental article in the form of a glass lens.

SUMMARY OF THE INVENTION

The problem underlying the present invention is not involved with disadvantages of these umbrella or walking stick handles, but results in the object of providing another corresponding handle, which is usable in particular as an incentive in the area of advertising articles, but may also be used by sportsmen.

Proceeding from a grip for an umbrella or walking stick of the type already mentioned, this object is fulfilled according to the invention by a spherical ornamental or commonplace article, which is removably housed in the end section, and is secured by a ring which may be mounted on an upper surrounding edge of the end section and has a smaller inner circumference than the outer circumference of the ornamental or commonplace article.

Thus the spherical article is secured against falling out from its hemispherical seat by the slightly narrower ring. In this respect it is particularly advantageous that the ring is removable, so that it is simply possible to remove the article from its seat and to exchange it for another. With reference to the embodiments given by way of example to be described in the following for the spherical ornamental or commonplace article, it will further become clear that the facility of removing the article in addition involves a large degree of flexibility in fitting the handle according to the invention with the most varied ornamental or commonplace articles. In addition, an article once inserted in the handle may also be temporarily removed for cleaning.

The umbrella cane or walking stick so designed is of particular interest as an incentive in the area of advertising articles, i.e. as a gift to clients or deserving employees, which will be explained in more detail in the following.

Advantageous further developments of the invention are disclosed in the sub-claims.

The range of ornamental or commonplace articles which may be inserted in the handle according to the invention is extremely wide and offers a large scope of possible applications, both in the area of advertising articles and also as "fan" articles or for sportsmen who themselves take part in a ball sport.

There is to be named as a first further development of the handle according to the invention that the ornamental or commonplace article can be a golf ball. The advantages of this further development reside in particular in the fact that the owner of the umbrella or of the walking stick can have a golf ball of his choice made into a component part of the umbrella or of the walking stick. This possibility can for example be of great interest if the owner of the umbrella or walking stick has won a golf tournament and inserts the ball played as a memento into the handle. In this respect of course care is taken that the inscription on the golf ball is aligned visibly upwards.

As an alternative to the golf ball, the ornamental or commonplace article can be a miniature soccerball, affording the possibility of use of the umbrella handle according to the invention as a "fan" article for soccerball clubs. Within the framework of this further development however other sports balls of the same range of magnitude may be mentioned, for example a squash ball or a miniaturised tennis ball. All these articles, inserted in the handle according to the invention are suitable to reflect the identification of the owner of the umbrella or walking stick with the respective type of sport or sports club.

According to another further development of the handle according to the invention, the ornamental or commonplace article is a transparent hollow plexi-glass sphere, which can for example be filled with samples of goods of a particular business, or with sweets. This further development corresponds not only with a pure use of the umbrella or walking stick in the field of advertising articles, but also opens up the possibility of its use as a child's umbrella or child's walking stick.

Finally, the ornamental or commonplace article can be a spherical mini-radio, a further development of the handle according to the invention by means of which the range of possible commercial applications of the handle is made clear, without the above enumeration of further developments being exclusive.

Basically, it is a factor with all playable golf balls that they may not exceed a specific weight (45.93 grams), and may not fall below a specific diameter (42.67 mm). In addition, every golf ball has a certain compressibility, which makes it possible for example to press the golf ball through a ring whose inner circumference is slightly smaller than the outer circumference of the golf ball. The same applies to a miniature football or a squash ball or similar sports balls of the same size. This compressibility of a conventional playable golf ball or of a miniature football or the like is made use of by a further development of the present invention according to which the inner circumference of the ring is so dimensioned that the golf ball or miniature football can be pressed into the seat formed by the end section by the application of a mechanical pressure. Thus the ball may be pressed, overcoming the resistance formed by the narrower ring, by the pressure of the thumb of a human hand into the hemispherical seat.

Preferably, the ornamental or commonplace article is accommodated up to two-thirds in the seat, so that it projects with about one-third above the upper edge of the ring. Then for example a golf ball imparts to the handle, with its particular dimples, a particularly attractive exterior.

In order to enable rotation of the ornamental or commonplace article within its seating, the inner diameter of the hollow end section is preferably slightly larger in dimensions than the outer circumference of the article. That is of advantage for example in the case of a golf ball or a miniature football if the script of the ball lying upwards as desired is no longer visible and this is to be altered again.

Preferably, the ring may be screwed onto the edge of the end section, enabling particularly simple removal of the ring. It is however also quite imaginable to mount the ring by means of a bayonet closure of a snap closure on the upper edge of the end section.

A particularly advantageous design of the umbrella or walking stick handle can be achieved in that the longitudinal axis of the end section encloses an angle with the longitudinal axis of the shaft. On the one hand this enables, even in the side view of the umbrella or of the walking stick, a plan view of the ornamental or commonplace article, and on the other hand, the handle also lies more reliably in the hand.

BRIEF DESCRIPTION OF THE DRAWINGS

A preferred embodiment of the invention given by way of example will be explained in the following with reference to a drawing. Shown are.

DETAILED DESCRIPTION OF THE PREFERRED EMBODIMENTS

Figure 1:
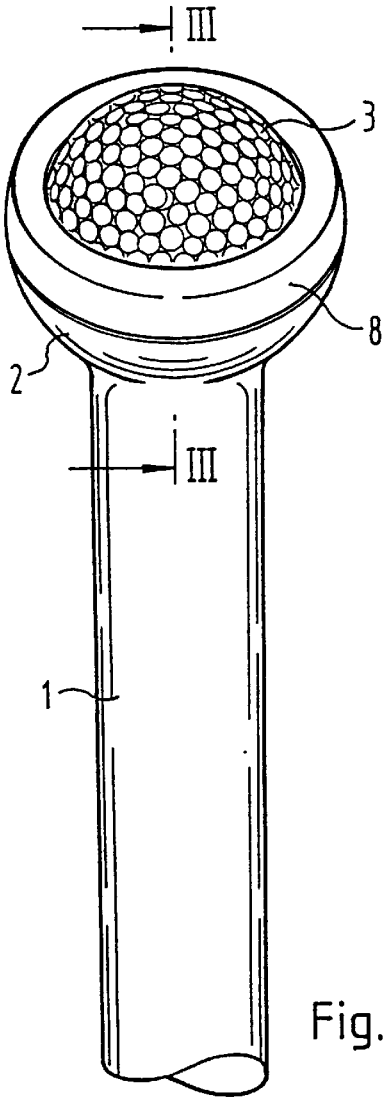
FIG. 1: a front elevation of an umbrella handle according to the invention.

FIG. 1 shows a front elevation of a handle for an umbrella or walking stick with a shaft 1 and a hemispherical end section 2, which forms the free end of the umbrella or walking stick. The hemispherical end section 2 is hollow in the interior and accommodates a golf ball 3, which projects to about a third out of the end section 2. The golf ball 3 is secured against falling out by an unscrewable ring 8.

Figure 2:
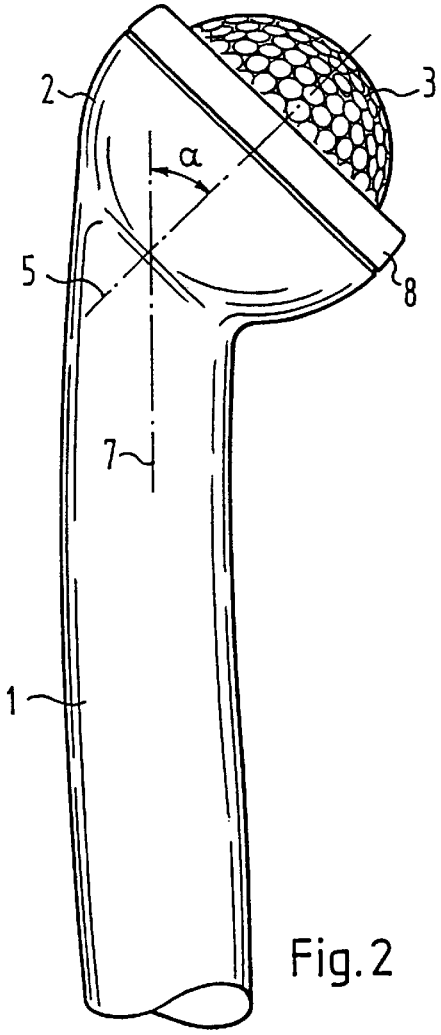
FIG. 2: a side elevation of the umbrella handle according to FIG. 1.

FIG. 2 shows a side elevation of the handle according to FIG. 1. This Figure shows that the longitudinal axis 5 of the hemispherical end section 2 encloses an angle $\alpha$ with the longitudinal axis 7 of the shaft 1.

Figure 3:
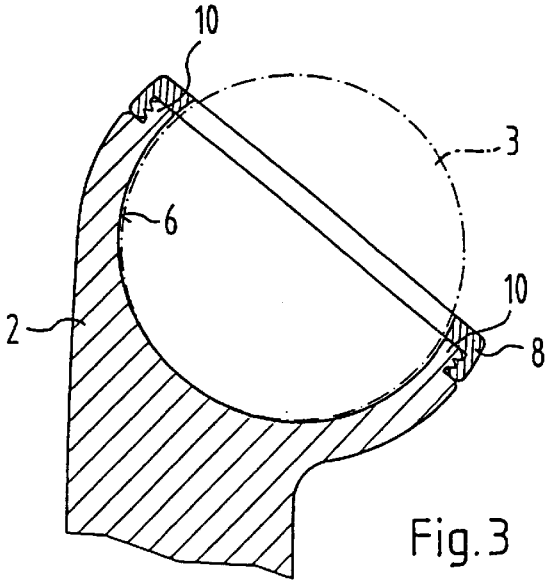
FIG. 3: a cross-section through the hemispherical end section along the line III—III of FIG. 1.

FIG. 3 shows a cross-section through the hemispherical end section 2 along the line III—III of FIG. 1. With reference to this cross-sectional view it can be seen that the end section 2 is internally formed as a hemispherical trough 6, into which the golf ball 3, here shown in dotted lines, fits smoothly. It is further clear that the ring 8 is screwed onto the upper edge 10 of the end section 2, in such a way that the ring 8 is applied above the upper half of the golf ball 3, so that the golf ball is secured in its position against falling out of the hemispherical trough 6. Naturally, a simple snap closure or a bayonet closure may be imagined for securing the ring 8 on the edge 10. The inner circumference of the ring 8 is in this case of such dimensions that the golf ball 3 can be pressed by the application of a mechanical pressure, for example by means of a thumb, through the ring 8 into the trough.

Figure 4:
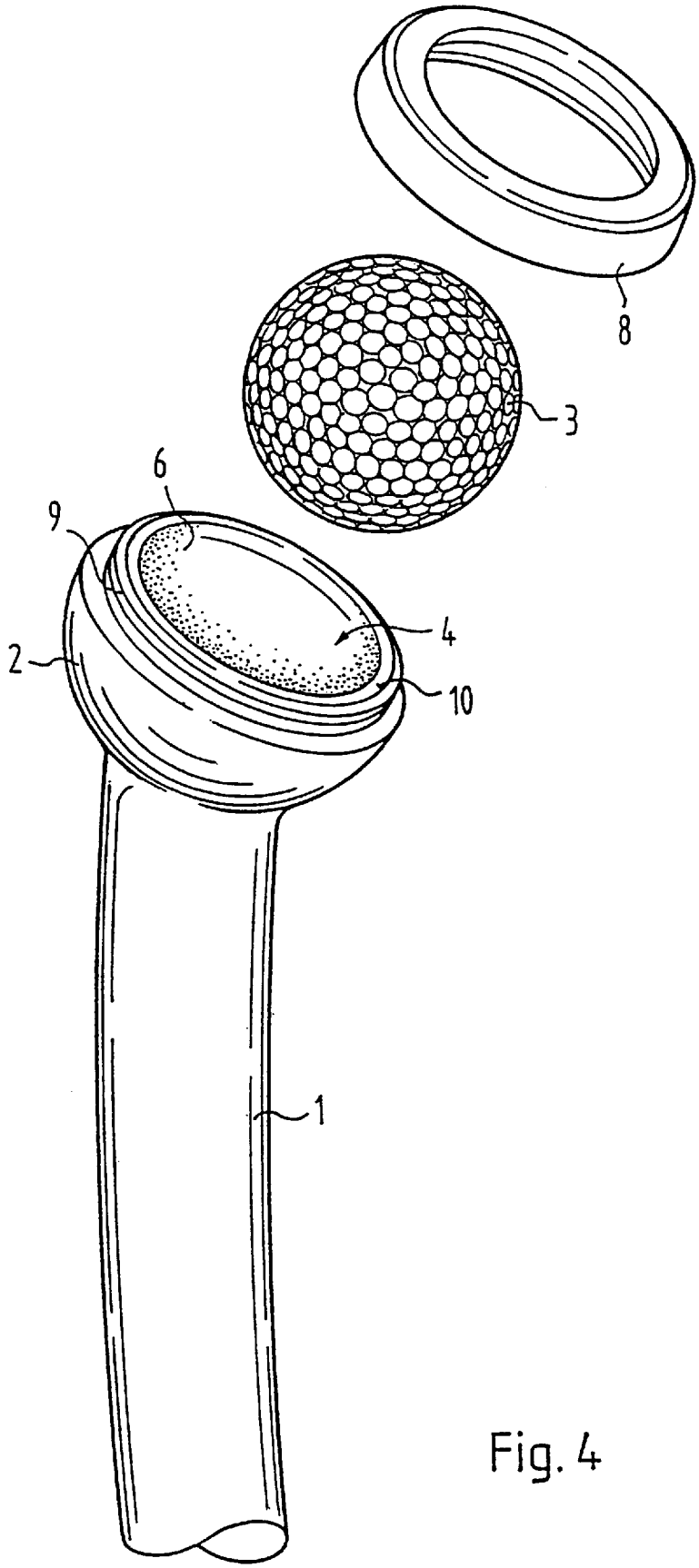
FIG. 4: an exploded view of an umbrella or walking stick handle according to the invention.

FIG. 4 shows an exploded view of the handle of FIGS. 1 to 3. From this perspective it can be seen that the hemispherical trough 6 forms a seat 4 for the golf ball 3, which is adapted to the spherical shape of the golf ball 3, and that the ring 8 may be screwed by means of a thread 9 onto the upper edge 10 of the trough 6 or of the end section 2. Due to the facility of removal of the ring 8 it is possible either to clean a golf ball 3 once it is inserted, or to exchange it for another golf ball 3.

Figure 5:
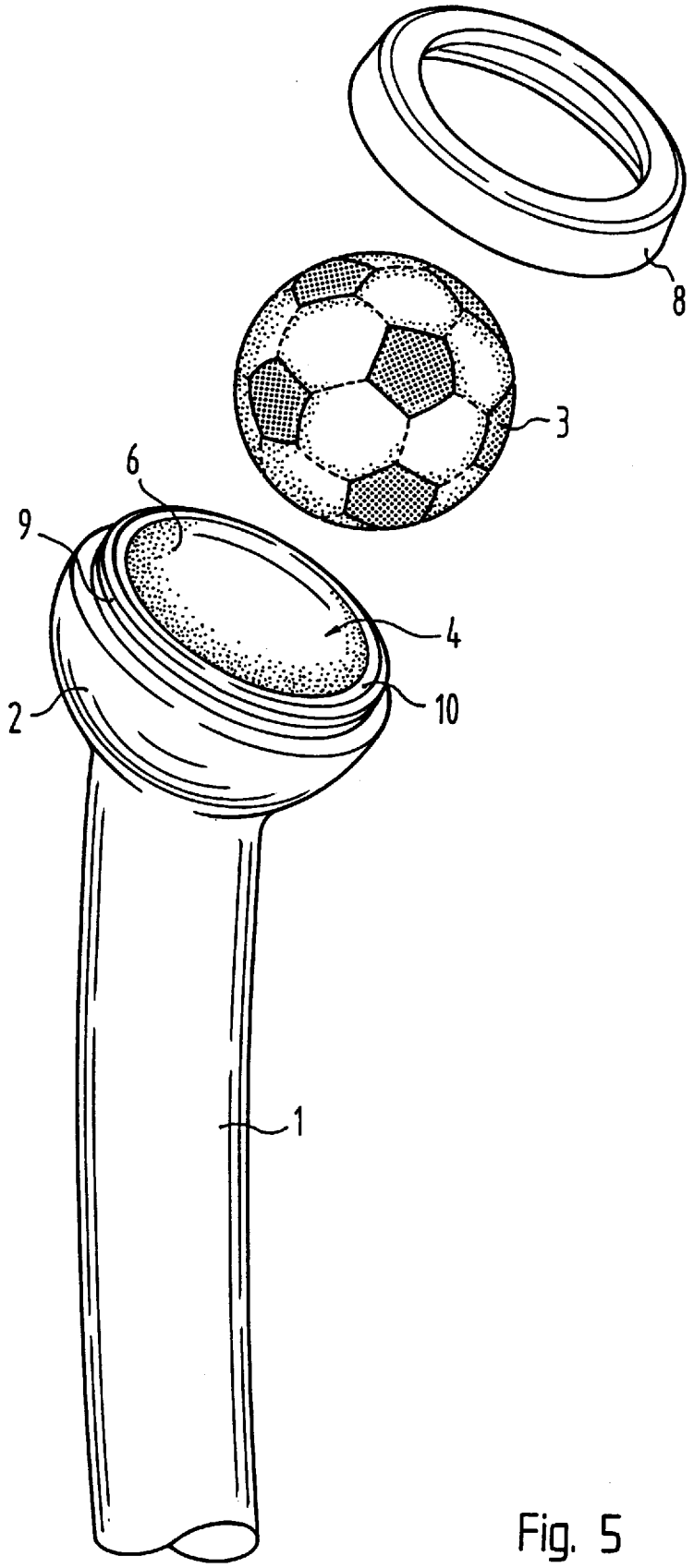
FIG. 5: an exploded view of an umbrella or walking stick handle according to a second aspect of the invention.
Figure 6:
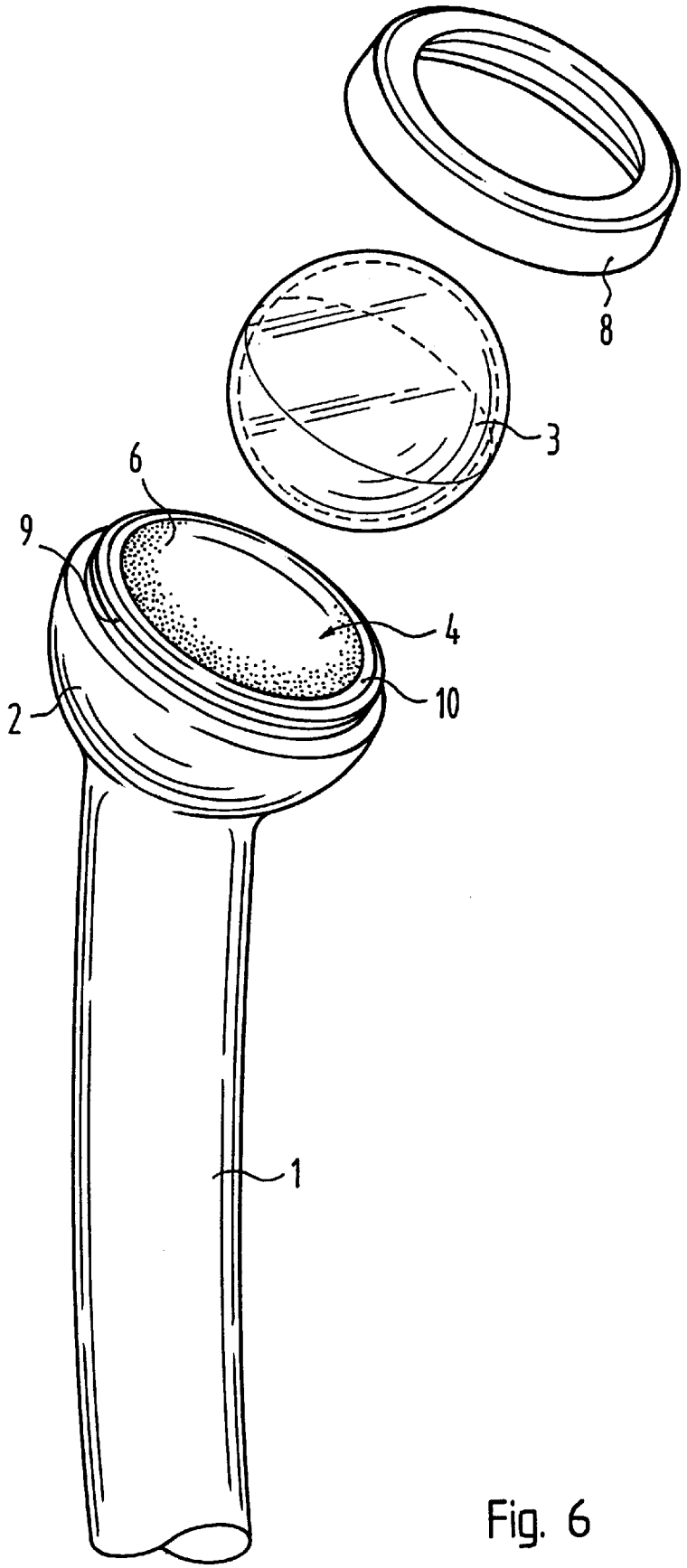
FIG. 6: an exploded view of an umbrella or walking stick handle according to a third aspect of the invention.
Figure 7:
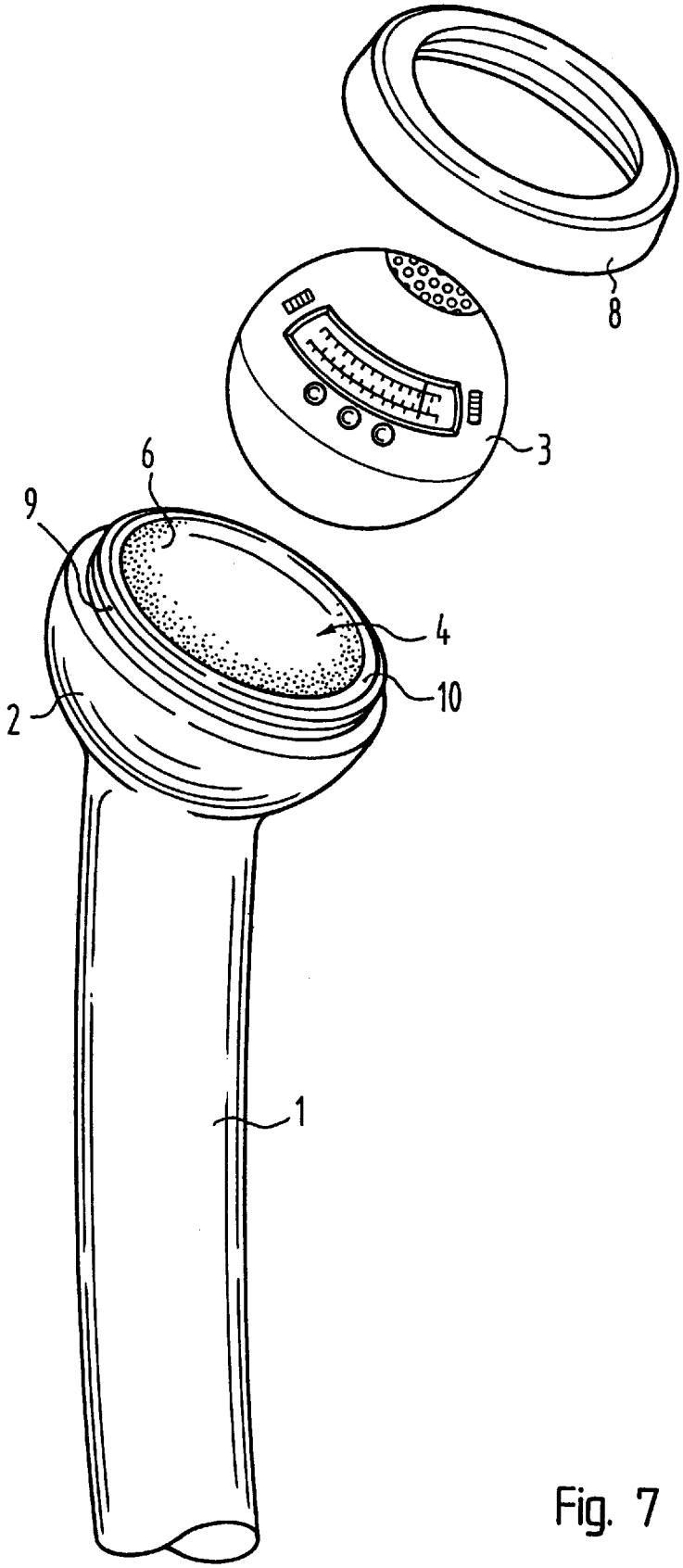
FIG. 7: an exploded view of an umbrella or walking stick handle according to a fourth aspect of the invention.
Figure 8:
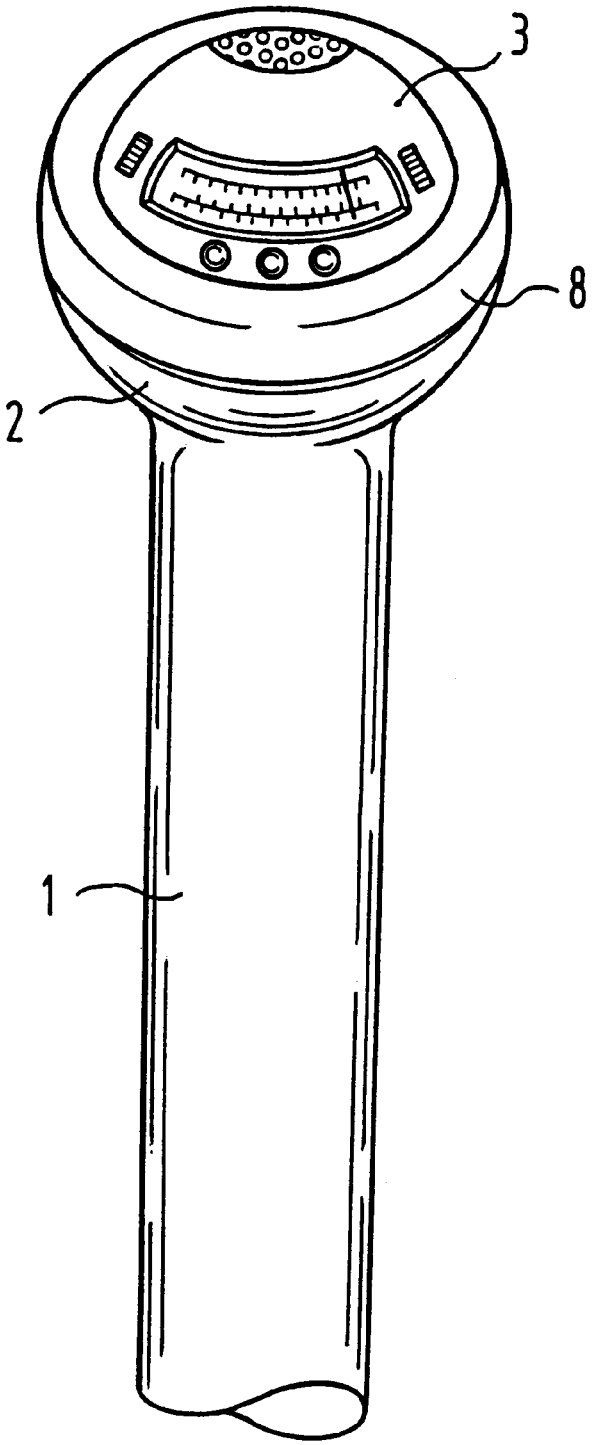
FIG. 8: a front elevation of an umbrella handle according to the fourth aspect of the invention.

FIGS. 5–7 show exploded views of the handle of FIGS. 1–3, with alternative ornamental or commonplace articles 3, including a miniature soccer ball (FIG. 5), a transparent hollow plexiglass sphere (FIG. 6), and a spherical radio (FIG. 7). FIG. 8 shows the assembled handle incorporating the spherical radio therein.

What is claimed is:

1. A handle for an umbrella or walking stick with a shaft and a hollow hemispherical free end section, comprising:

a spherical ornamental or commonplace article, which is accommodated removably in the end section, and a ring, which is capable of being mounted on an upper surrounding edge of the end section and has a smaller inner circumference than the outer circumference of the ornamental or commonplace article.

2. The handle according to claim 1, wherein the ornamental or commonplace article is housed up to about two-thirds in a seat formed by the end section.

3. The handle according to claim 1, wherein the ornamental or commonplace article is movably accommodated in a seat formed by the end section.

4. The handle according to claim 1, the ring is capable of being screwed onto the edge of the end section.

5. The handle according to claim 1, wherein the longitudinal axis of the end section encloses with the longitudinal axis of the shaft an angle.

6. The handle according to claim 1, wherein the ornamental or commonplace article comprises a golf ball.

7. The handle according to claim 6, wherein the ornamental or commonplace article is housed up to about two-thirds in a seat formed by the end section.

8. The handle according to claim 6, wherein the ornamental or commonplace article is movably accommodated in a seat formed by the end section.

9. The handle according to claim 1 wherein the ornamental or commonplace article comprises a miniature soccer ball.

10. The handle according to claim 9, wherein the inner circumference of the ring comprises such dimensions that the spherical ornamental or commonplace article is capable of being pressed by application of a mechanical pressure through the ring into a seat formed by the end section.

11. The handle according to claim 9, wherein the ornamental or commonplace article is housed up to about two-thirds in a seat formed by the end section.

12. The handle according to claim 9, wherein the ornamental or commonplace article is movably accommodated in a seat formed by the end section.

13. The handle according to claim 1 wherein the ornamental or commonplace article comprises a transparent hollow plexiglass sphere.

14. The handle according to claim 13, wherein the ornamental or commonplace article is housed up to about two-thirds in a seat formed by the end section.

15. The handle according to claim 13, wherein the ornamental or commonplace article is movably accommodated in a seat formed by the end section.

16. The handle according to claim 1 wherein the ornamental or commonplace article comprises a spherical mini-radio.

17. The handle according to claim 16, wherein the ornamental or commonplace article is housed up to about two-thirds in a seat formed by the end section.

18. The handle according to claim 16, wherein the ornamental or commonplace article is movably accommodated in a seat formed by the end section.

19. The handle according to claim 1, wherein the inner circumference of the ring comprises such dimensions that the spherical ornamental or commonplace article is capable of being pressed by application of a mechanical pressure through the ring into a seat formed by the end section.

20. The handle according to claim 19, wherein the ornamental or commonplace article is housed up to about two-thirds in a seat formed by the end section.

* * * * *